United States Patent [19]

Fujiwara et al.

[11] Patent Number: 4,889,567

[45] Date of Patent: Dec. 26, 1989

[54] HIGH STRENGTH AND HIGH TOUGHNESS STEEL BAR, ROD AND WIRE AND THE PROCESS OF PRODUCING THE SAME

[75] Inventors: Tadayoshi Fujiwara, Mino; Yukio Yamaoka, Sakai; Kazuichi Hamada, Mino; Yoshiro Yamada, Akashi; Yasunobu Kawaguchi, Kobe; Yasuhiro Oki, Kobe; Takashi Taniguchi, Kobe; Hiroyuki Takahashi, Kobe, all of Japan

[73] Assignees: Kabushiki Kaisha Kobe Seiko, Kobe; Shinko Kosen Kogyo Kabushiki, Amagasaki, both of Japan

[21] Appl. No.: 214,817

[22] Filed: Jul. 1, 1988

Related U.S. Application Data

[63] Continuation of Ser. No. 841,291, Mar. 19, 1986, abandoned.

[30] Foreign Application Priority Data

May 14, 1985 [JP] Japan ..... 60-102273

[51] Int. Cl.[4] ..... C22C 38/02; C21B 8/06

[52] U.S. Cl. ..... 148/12 B; 148/12 F; 148/320; 148/333

[58] Field of Search ..... 148/12 B, 12 F, 320, 148/333; 420/8, 104, 128

[56] References Cited

U.S. PATENT DOCUMENTS

| | | | |
|---|---|---|---|
| 3,617,230 | 11/1971 | Richards et al. | 148/320 |
| 3,668,020 | 6/1972 | Lucht | 148/12 B |
| 4,046,600 | 9/1977 | Yamakoshi et al. | 148/36 |

FOREIGN PATENT DOCUMENTS

| | | | |
|---|---|---|---|
| 543136 | 11/1977 | Australia . | |
| 2163163 | 11/1972 | Fed. Rep. of Germany | 148/12 B |
| 224619 | 7/1985 | Fed. Rep. of Germany | 148/12 B |
| 1402454 | 5/1965 | France . | |
| 53-54115 | 5/1978 | Japan | 148/12 B |
| 55-24956 | 2/1980 | Japan | 148/12 B |
| 57-140833 | 8/1982 | Japan | 148/12 B |
| 232332 | 7/1985 | Japan . | |

OTHER PUBLICATIONS

ASM, "Cold Drawing Steel Wire", Metals Handbook, pp. 358–359, Edited 1948.

*Chemical Abstracts,* vol. 99, No. 8, Aug. 22, 1983, p. 215, Abstract No. 57328m, Columbus, Ohio, U.S.; "High--carbon steel wire with excellent drawability", Nippon Steel Corp.

*Stahl und Eisen,* vol. 97, No. 9, May 5, 1977, pp. 464–466, L. Tegel, "Direkte wasserkuehlung des Drahtes and Mehrfach-Ziehmaschinen", FIGS. 1, 2, p. 464 last paragraph; p. 465, left-hand col. line 13.

"Application of Stelmor Processed High-Silicon Steel Wire Rod to Prestressed Concrete Wire and Strand", Oct. 1981, Nippon Steel Corporation.

*Primary Examiner*—Deborah Yee

*Attorney, Agent, or Firm*—Oblon, Spivak, McClelland, Maier & Neustadt

[57] ABSTRACT

Wire rods containing an adequate quantity of C within the range from 0.70 to 1.00%, Si from 0.5 to 3.0%, Mn from 0.30 to 2.0%, Cr from 0.10 to 0.5%, Al from 0.030 to 0.10% and N from 0.004 to 0.015% and unavoidable impurities, and with Fe for all the rest are subjected to re-heat patenting to increase the tensile strength to 135 kgf/mm$^2$ or higher, then are drawn by adequately selecting the conditions, number of times of drawing in the range from 7 to 16 times, drawings speed from 50 to 550 m/minute, extent of drawing form 70–90, and water cooling immediately after each drawing to manufacture steel wires of high strength and high toughness.

The wires are used as PC wires, steel wires for skewed bridge cables, steel stranded wires, spring wires, main cable wires for extra-long suspension bridge large diameter wires for core of aluminum cables steel reinforced (transmission cable), and as galvanized steel wires for such applications.

16 Claims, 11 Drawing Sheets

HIGH STRENGTH AND HIGH TOUGHNESS STEEL BAR, ROD AND WIRE AND THE PROCESS OF PRODUCING THE SAME

This application is a continuation of application Ser. No. 841,291, filed on Mar. 19, 1986, now abandoned.

BACKGROUND OF THE INVENTION

This invention relates to a manufacturing process of high strength and tough steel bar, rod and wire, (hereinafter briefly referred to as wire) and the process for producing the same.

Increase in total reduction in area of drawing or increase in the strength of raw material is generally adopted in order to attain high strength steel wire. In case the total reduction in area is increased to attain higher strength wire, however, the toughness is sharply lowered when the strength of wires reaches the area shaded in FIG. 12. In other words delamination takes place at torsion test. As the bending property also deteriorates, it can also cause breakage of ropes, aluminium cables steel reinforced and PC strand at the stage of stranding or closing, breakage at the stage of forming spring, or breakage of wire in the middle of drawing.

Cr has been used increase the strength of raw material after patenting. Addition of Cr, however, increases smut at the pickling process before drawing. Productivity and efficiency in the drawing process is lowered due to longer pickling time and defective lubrication film caused by smut.

In order to attain the plated high carbon hard drawn steel wire or piano wire as specified in Japan Industrial Standard (JIS), it is necessary to increase strength of the steel wire before plating as the strength is greatly lowered by galvanizing.

According to JIS, high carbon steel wire is specified by diameter and tensile strength, for example hard drawn steel wire is specified by the tensile strength of 220 kgf/mm$^2$ or higher for 1.0 mm diameter and smaller, and by over 200 kgf/mm$^2$ for 2.5 mm diameter and smaller. Where the diameter is over 3.5 mm, however, 210 kgf/mm$^2$ can hardly be attained even with piano wire. This is because the torsion value of wire with the diameter of 3.5 mm and over is diminished to an abnormal level when tensile strength of piano wire exceeds 220 kgf/mm$^2$ or delamination takes place in torsion test, is higher deformation to attain the tensile strength exceeding (240–68 log d) kgf/mm$^2$ and it makes the manufacturing difficult. For hard drawn steel wires of lower grade, in particular, it is very hard to maintain high toughness with the strength of over 210 kgf/mm$^2$ for the wire with the diameter of 1.5 mm and larger as the required reduction of impurity at manufacturing is not so strict as is required for piano wire.

Accordingly, to the uncoated stress-relieved steel wire and strand for prestressed concrete of JIS G3536 (ASTMA421), the practical tensile strength has been 197 kgf/mm$^2$ or higher for wire of 2.9 mm diameter, 165 kg/mm$^2$ or higher for 5 mm diameter, and 189 kgf/mm$^2$ or higher even for strand wires. Particularly, manufacturing of large diameter strand wires of 12.4 mm, 15.2 mm and 17.5 mm diameters have been difficult as they are made of large diameter wires of 4.2 mm or larger twisted together.

The ropes of large diameter made of two or more wires twisted together require strands of 1.5 mm and larger in most cases, and the toughness is deteriorated by the use of large diameter wire. Accordingly, wires for ropes of over 210 kgf/mm$^2$ and of over 1.5 mm diameter are not manufactured, which makes the practical application of large diameter high strength rope difficult.

Of the galvanized steel wires for the aluminium cables steel reinforced is specified in JIS C3110 (ASTM B498), those of 2.6 mm diameter with tensile strength of over 180 kgf/mm$^2$ are produced in large quantity. When the tensile strength exceeds 210 kgf/mm$^2$, however, the torsional characteristic deteriorates and practical application has not been made possible at the present situation.

When the ordinary high carbon steel wire rod is drawn under the conditions of 8 passes of drawing, 200 m/minute of drawing speed, and 90% reduction in area for example, the torsion value is greatly reduced and the following problems are raised to respective products.

(A) PC wire

At the final taking up of wire after drawing, the wire is broken at the turn roller and the coil straightening roller, thus making the manufacturing impossible. Even if the wire can be manufactured without breakage, the wire is often broken by the anchoring chuck during tensioning at the stage of introducing prestressing force, thus making commercialization impossible.

(B) PC strand

Besides the problem mentioned above, breakage occurs at the stage of stranding if the embrittlement is excessive and thus manufacturing of PC strand is practically impossible. The merit of processing for high strength wire is not obtained because the anchoring efficiency of the strand wire is low due to the brittleness of wire.

(C) Galvanized steel wire

As to the galvanized steel wire for ACSR (aluminium cables steel reinforced) torsion value is specified at the value of more than 16 turns or more than 20 turns. Embrittled steel wires do not meet the specified torsional value due to delamination. As a low torsion value leads to a low fatigue strength it makes commercialization difficult.

(D) Rope

A low torsion value makes stranding impossible. The bending fatigue strength which is an important characteristic for wire rope is also low, and it may lead to serious trouble due to breakage during use.

To prevent embrittlement of steel wires, cold drawing methods are also employed in which the wire, after drawing, is cooled directly with water together with the rear face of the dies to reduce heat generation from the wire at drawing and to cool the wire quickly. For manufacturing of high strength and high toughness wire, however, such methods as the compositions, number of passes of drawing, total reduction in area, patenting, and cold drawing are combined systematically have not been adopted so far.

SUMMARY OF THE INVENTION

In view of the prior art described above, it is a general object of this invention to provide a manufacturing method of steel wires which have properties of high strength, with the tensile strength exceeding (240–68 log 4) kgf/mm$^2$, and high toughness.

This invention describes that the compositions of high carbon steel wire rods can be advantageously adjusted by adding Si, Si-Cr, Si-Mn, Si-Mn-Cr, Si-Mn-Al and Si-Mn-Cr-Al to obtain a quality product by using a very specific process. In this process the patenting strength is improved by heat treatment at the optimum patenting condition. The wire rods are subjected to cold drawing while limiting total reduction in area, the number of passes of drawing, and the drawing speed.

DETAILED DESCRIPTION OF THE INVENTION

Figure 1:
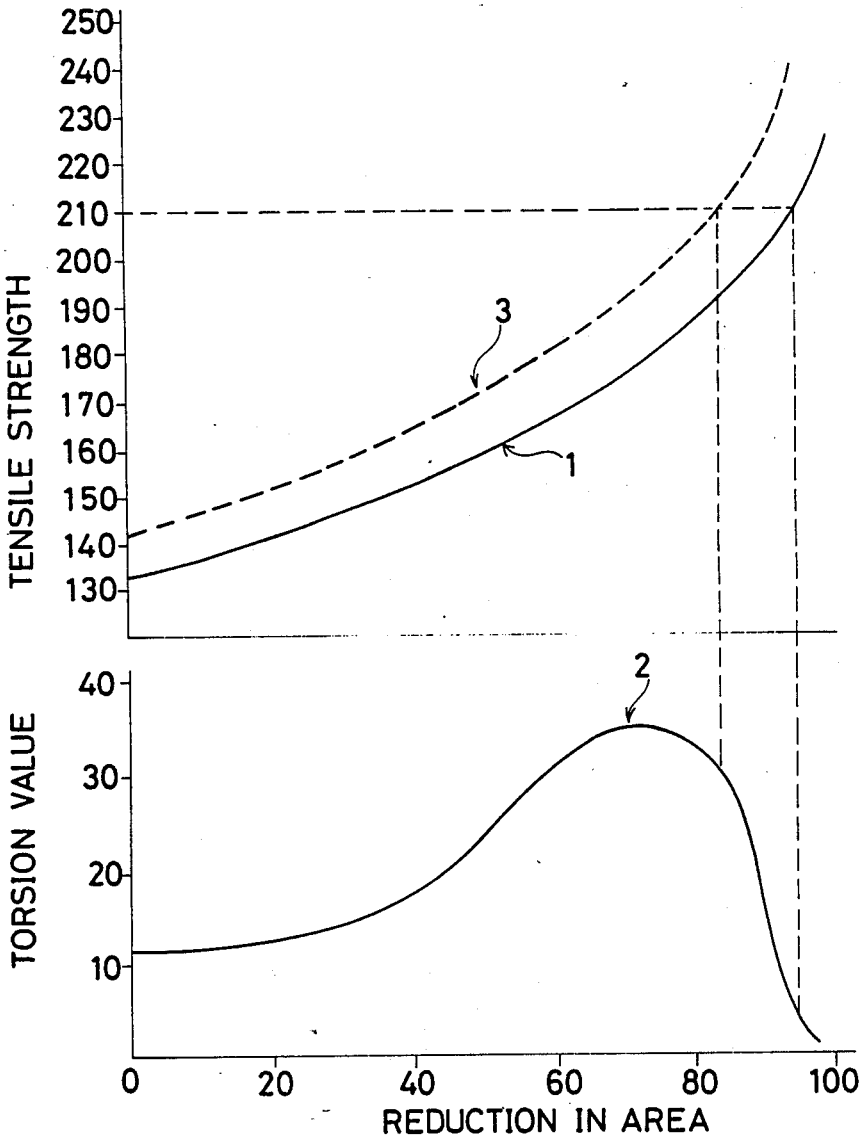
FIG. 1 shows the relationship among tensile strength, torsion value, and reduction in area, FIG. 2 and FIG. 3 respectively show the relationship between tensile strength and carbon equivalent.

As shown in FIG. 1, the tensile strength indicated by line 1 of a conventional material increases as reduction in area increases but the number of times of twisting indicated by line 2 reduces sharply when tensile strength exceeds a certain level and embrittlement is accelerated.

If the strength as being patented is increased, the tensile strength will therefore increase as shown by line 3. The torsion value mainly depends not on the initial tensile strength of the patented wire, but on the total reduction in area of drawing. Accordingly, a high torsion value is obtained even at a high strength of over 210 kgf/mm$^2$ provided that such drawing method is employed as the toughness is not deteriorated. The chemical composition by which high tensile strength as patented can be attained and which are practical are therefore specified as shown below:

(Si - Mn series)
C: 0.70~1.00%
Si: 0.50~3.0%
Mn: 0.3~2.0%
(Si - Mn - Cr series)
C: 0.70~1.00%
Si: 0.50~3.0%
Mn: 0.30~2.0%
Cr: 0.10~0.50%
(Si - Mn - Al series)
C: 0.70~1.00%
Si: 0.50~3.0%
Mn: 0.30~2.0%
Al: 0.02~0.10%
N: 0.003~0.015%
(Si - Mn - Cr - Al series)
C: 0.70~1.00%
Si: 0.50~3.00%
Mn: 0.30~2.0%
Cr: 0.10~0.50%
Al: 0.020~0.100%
N: 0.003~0.015%

P and S are also included as unavoidable impurities for steel making and the rest is Fe. The reasons to limit the components to the above are;

C: The patenting strength is increased by 16 kgf/mm$^2$ per 1% of C and the required strength is not obtained at 0.7% or lower content. Higher C % is, therefore, advantageous to increase the strength. When the content exceeds 1.00%, however, network cementite is precipitated in the grainboundary affecting the toughness.

Si: The patenting strength is increased by 12 kgf/mm$^2$ per 1% addition of Si and heat resistive strength is also increased by Si addition. When the content exceeds 2%, however, solid hardening of ferrite increases, decarburizing tends to happen at rolling and at reheating, and the elongation and the contraction properties are lowered sharply. The upper limit, therefore, is set at 2%. The materials specified in JIS ordinarily include 0.3% Si and the lower limit in this invention is 0.2% higher than this, and at least 6 kgf/mm$^2$ or higher increase in the patenting strength is intended.

Mn: As the result of improvement in hardenability, Mn content moves the rate of transformation to the side of longer time, generates fine pearlite even with steel wires of large diameter, and serves for strength improvement. At 0.3% or lower content, however, the effect is insignificant. When the content exceeds 2%, however, the time required to hold in a lead bath in order to complete pearlite transformation at patenting becomes too long, which is not practical.

Cr: Cr is a effective element for strengthening as it is adequately dissolved into ferrite matrix, and also into $Fe_3C$ being an element producing carbide, and the strength of $Fe_3C$ is increased, the reaction of pearlite transformation is delayed serving to move the transformation to the side of longer time and making it easier to obtain fine pearlite even with larger diameter wire rods. When 0.5% is exceeded, however, completion of pearlite transformation during patenting takes too long to make pearlite transformation practical. Therefore, the upper limit is set at 0.5% for Si - Cr and Si - Mn - Cr, but the lower limit is set at 0.1% as the effect of strengthening is not expectable if the addition is less than 0.1%. To Si - Mn series, no Cr is added because the time to complete transformation becomes too long.

Al: Al is added at ordinary steel making for deoxidation and 0.02% or more is added to make grain size of crystal finer and to improve the toughness. Addition of 0.02% Al or more greatly improves twist characteristic after drawing and bending workability and reduces breakage at machining and use of the products. Addition of Al, however, is kept within the range from 0.02 to 0.100% as addition of over 0.100% increases $Al_2O_3$, which reduces drawability.

N is effective to improve toughness after drawing if included by more than 0.003% within the range of Al addition mentioned above. If the content exceed 0.015%, however, the effect of improvement is lowered and drawability is affected. Accordingly, addition of N is kept within the range from 0.003 to 0.015%.

It is also possible to add one or more of Ti, Nb, V, Zr, B and Al within the limit of 0.3% in total quantity to obtain fine grain size. Addition of over 0.3% only saturates effect of fine grain size of austenite crystal and results in deterioration of toughness. Accordingly, the total quantity is kept at 0.3% maximum.

The control by addition of Ca or rare earth elements and steels processed to reduce impurities such as P, S, N, and O do not spoil the effect of the present invention either.

Figure 2:
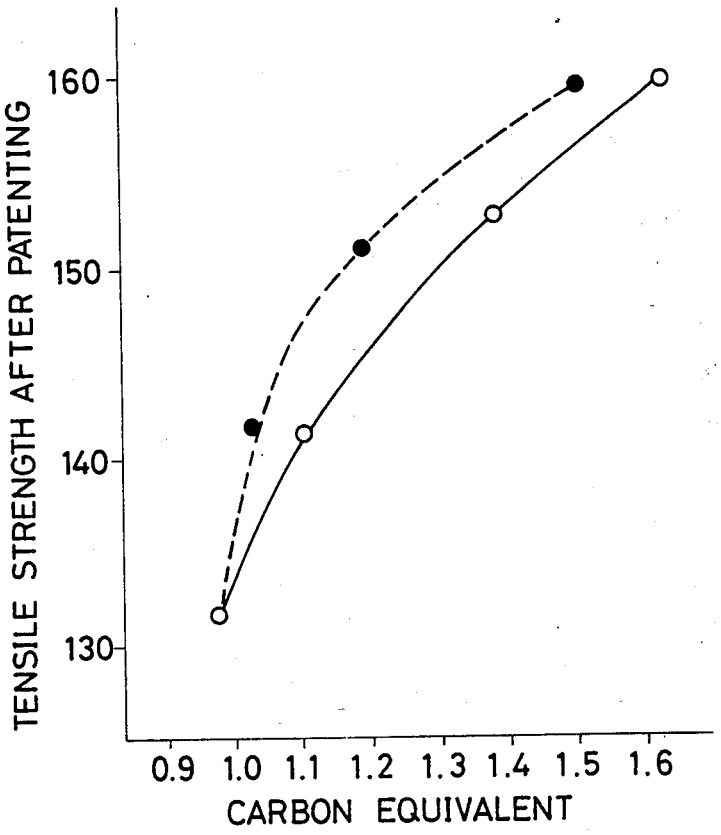

FIG. 2 shows the compositions of Si - Mn and Si - Cr series in terms of carbon equivalent (Ceq=C+(Mn+Si)/6+Cr/4) and in relation to the strength after lead patenting. The patenting strength is 140 kfg/mm$^2$–160 kgf/mm$^2$ at Ceq of 1.1 to 1.6 to Si - Mn and at 0–1.5 to Si - Cr, which indicates the effect of strengthening.

Figure 3:
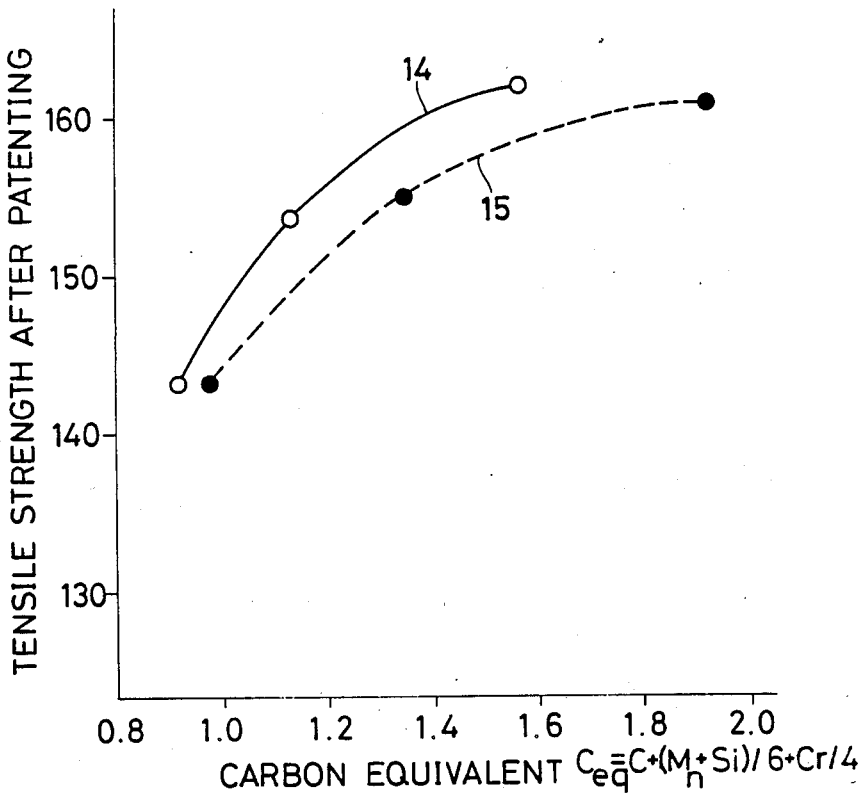

FIG. 3 shows the components of Si and Si - Mn - Cr series in terms of carbon equivalent (Ceq=C+(Mn+Si)/6+Cr/4) and in relation to the strength after lead patenting. The patenting strength is 140–162 kgf/mm$^2$ at Ceq of 0.93–1.60 to Si series as shown by line 14 and 0.99–1.95 to Si - Mn - Cr as shown by line 15, which indicates the effect of strengthening.

In the following description of the method of drawing were rods of high patenting strength and having the compositions described above for manufacturing high strength and high toughness steel wires, Si series and Si - Mn - Cr series are not separated one from the other as they show the same tendency.

Figure 4:
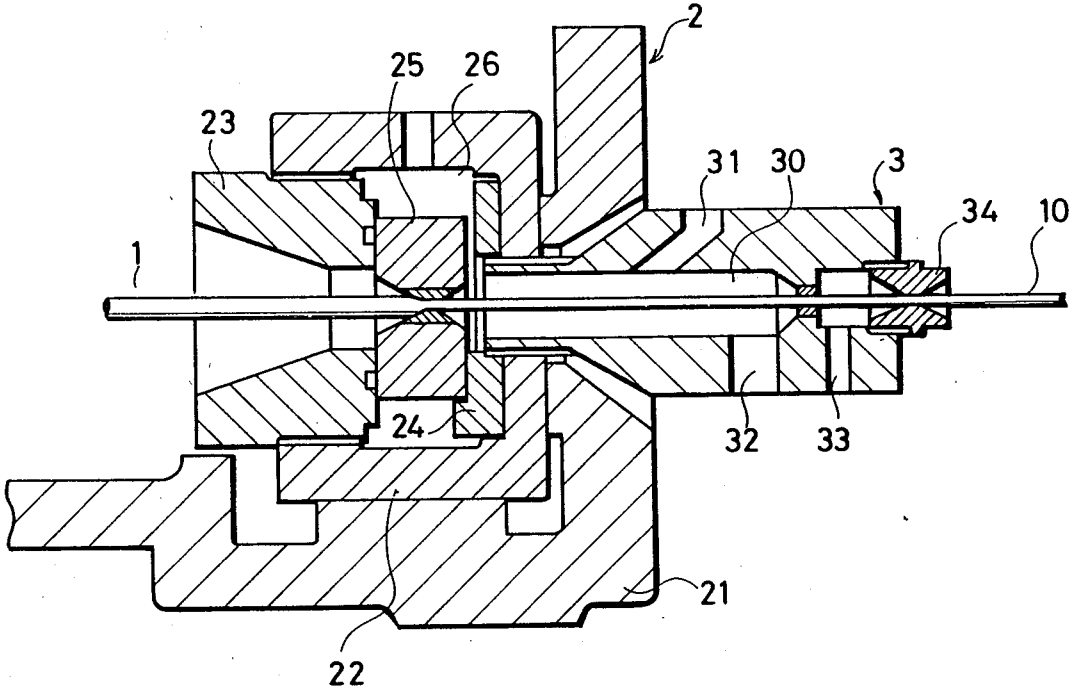
FIG. 4 is a sectional view of the equipment for drawing and cooling.

FIG. 4 is an example of drawing and cooling device to directly cool down heated steel wires by drawing. The drawing and cooling device 2 has a die box 21, a die case 22 retained by the die box 21, a case cap attached to the die case 22, and a die 25 caught by a spacer 24 and the case cap 23 in the die case 22, and a cooling chamber 26 to cool the die 25 is provided in the die case 22 into which cooling water is lead. A cooling unit 3 is connected to the drawing unit 2, and a cooling chamber 30 is made in the cooling unit 3. Cooling water is lead into the cooling chamber through a cooling water inlet 31 and discharged through an outlet 32. A guide member 34 is provided at the back of the cooling unit to feed air to the periphery of steel wires passing through the guide from an air feed port 33 to dry the wires. A steel wire 1 goes through the cap 23 and is drawn by the die 25. The drawn steel wire 10 is cooled immediately while going through the cooling chamber. Moisture on the periphery is removed by air while the wire goes through the guide member 34.

Since the drawn wire 10 is cooled at the die outlet in this manner, embrittlement by strain aging is prevented. The drawing by the die and water cooling after drawing are repeated by the specified number of passes. The use of the direct water cooling device shown, as an example, in FIG. 4, can be omitted at one or a few dies.

No adoption of direct water cooling is harmless for wire properties at first die or for a few dies at early stage of drawing.

This is because wire temperature rise at the early stages of continuous drawing is usually smaller than that at the latter stages of drawing, and the strain age embrittlement hardly takes place.

Figure 5:
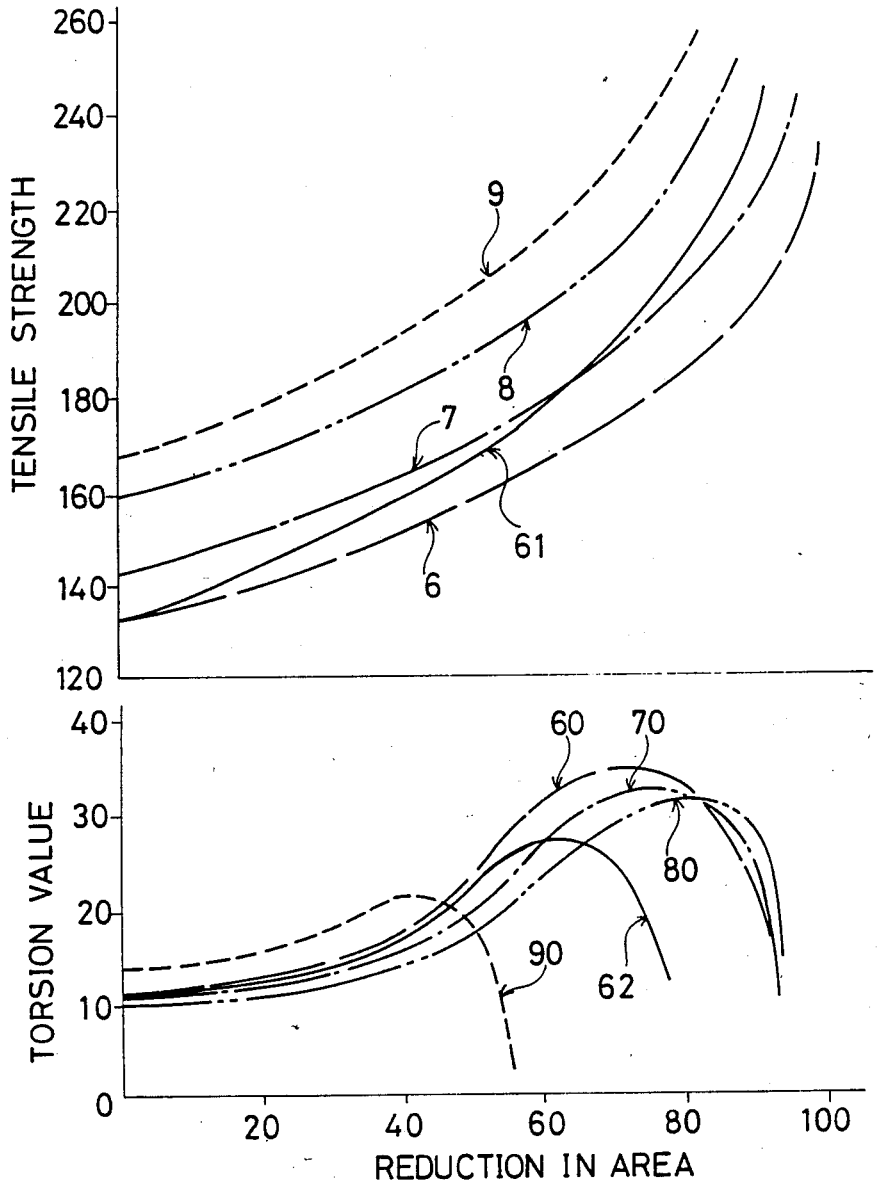
FIG. 5 shows the relationship between the torsion value and tensile strength and reduction in area in the manufacturing of conventional steel wires and the steel wires by this invention.

FIG. 5 shows the relationship of tensile strength and twisting to the change in total reduction in area and in patenting strength when the device shown in FIG. 4 is used for drawing. The wire of 133 kg/mm$^2$ patenting strength shown by line 6 is ordinary material (conventional) with 0.82 C, 0.3 Si and 0.5 Mn components, and the wires of 142 kgf/mm$^2$ shown by line 7 and of 160 kgf/mm$^2$ shown by line 8 are respectively the materials of Si - Cr series and Si - Mn series according to this invention. The one shown by line 9 and having 168 kgf/mm$^2$ patenting strength contains 2.0% Si content, which is larger than the limited range. The twisting of the materials of line 6, 7, 8, and 9 is respectively as shown by line 60, 70, 80 and 90.

As the drawings indicate, the required torsion value, 20 turns, is not met by ordinary steel material when the tensile strength exceed (240–68 log d) kgf/mm$^2$. (d: diameter of wire). With the materials of this invention, however, the required twisting of over 20 turns can be met even at high strength exceeding (240–68 log d) kgf/mm$^2$. The material with increased Si content to 3% shows significant embrittlement and very low number of times of twisting. For the materials of this invention, it is necessary to limit reduction in area to 70–93% as the tensile strength exceeds (240–68 log d) kgf/mm$^2$ at 70% and over, and torsion value is less than 20 turns at over 93% of drawing.

Figure 6:
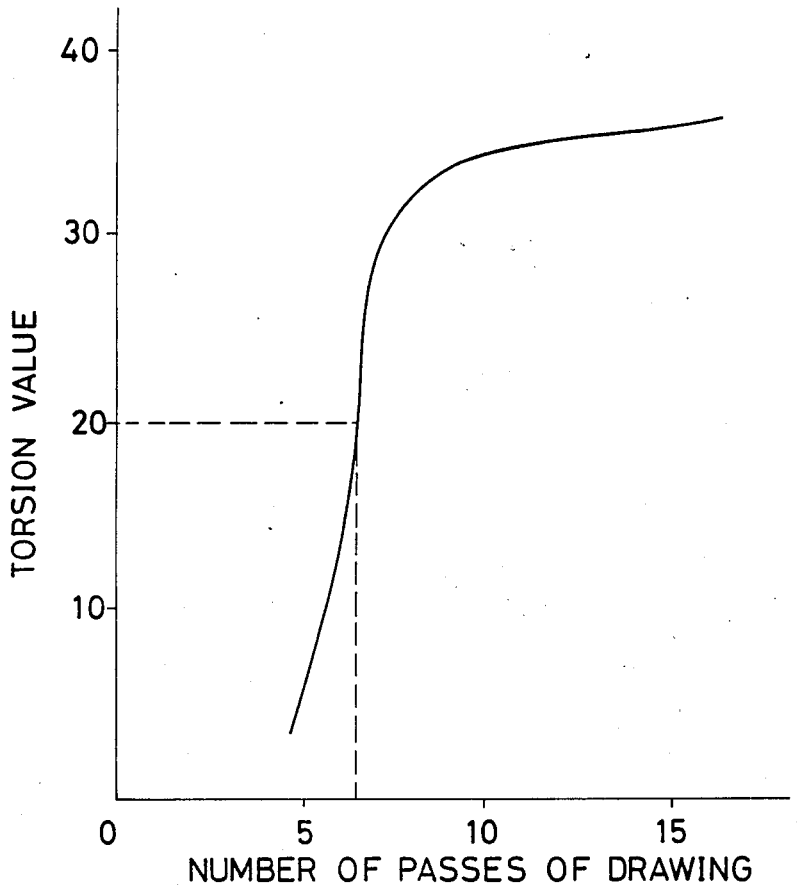
FIG. 6 shows the relationship between number of passes of drawing and torsion value.

It is also necessary to limit the patenting strength over 140 kgf/mm$^2$ as the torsion value of over 20 turns is met at tensile strength exceeding (240–68 log d) kgf/mm$^2$. Ordinary wire materials are also affected by cooling after drawing and when no cooling is applied after drawing, the material having the characteristic of line 61 is embrittled significantly as shown by line 62. Wire materials of the present invention also show the same tendency and the cooling as described in FIG. 4 or other comparable direct cooling methods is therefore essential. The number of times of drawing is set at 16 as reduction in area per one die is too much if the number of passes of drawing is 6 or less and the embrittlement as shown in FIG. 6 is resulted due to excessive heat generation. If the number of times of drawing is too much, on the other hand, the economical performance becomes lower though there is no problem in the characteristics.

Figure 7:
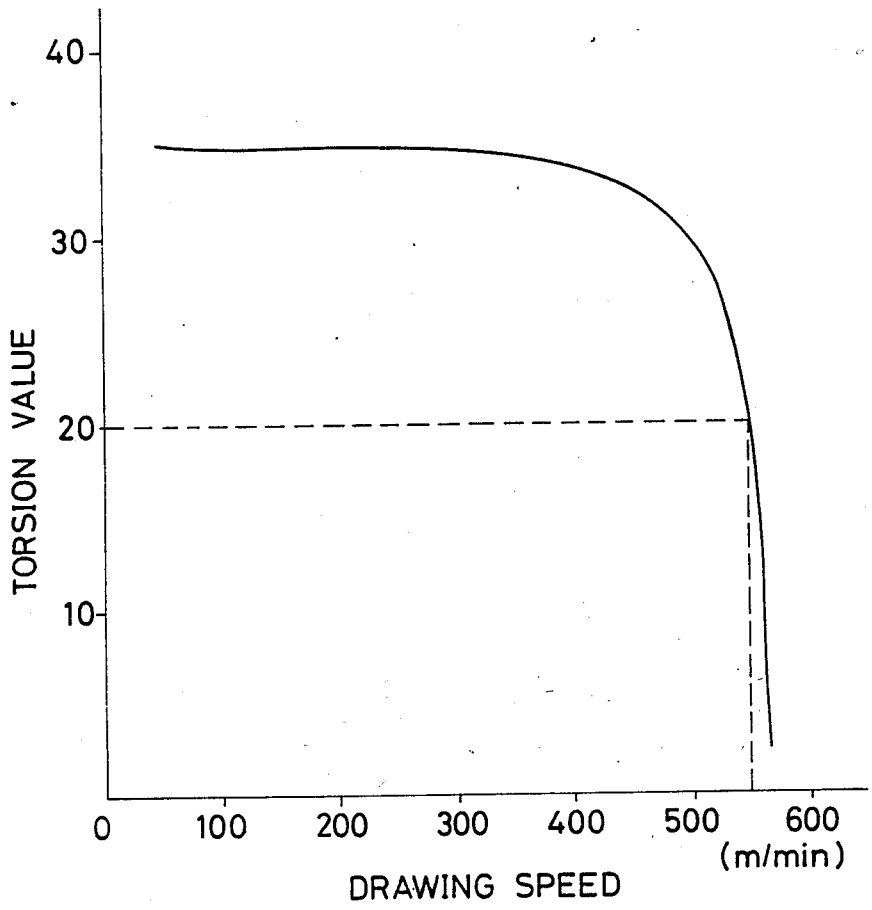
FIG. 7 is to show the relationship between torsion value and the drawing speed.

FIG. 7 shows the relationship between torsion value and drawing speed of the wires showing tensile strength exceeding (240–68 log d) kgf/mm$^2$. The drawing speed of 550 m/minute max. is desirable as wires are broken at higher speed than 550 m/minute. The lower limit of drawing speed is set at 50 m/minute and faster though the drawing is free from embrittlement at lower speed side and the economical performance becomes lower at a slower speed than 50 m/minute. According to the results described above, this invention is to be composed as follows:

Compositions . . . As described above
Drawing method . . . Drawing and cooling immediately after drawing
Patenting strength . . . Over 140 kgf/mm$^2$
Number of times of drawing . . . 7–16 times
Drawing speed . . . 50–550 m/minute
Reduction in area . . . 70–93%

High tension and highly tough steel wires having tensile strength exceeding (240–68 log d) kgf/mm$^2$ and number of times of twisting of over 20 turns can be manufactured by limiting each one of the above stated conditions within a specific range.

Figure 8:
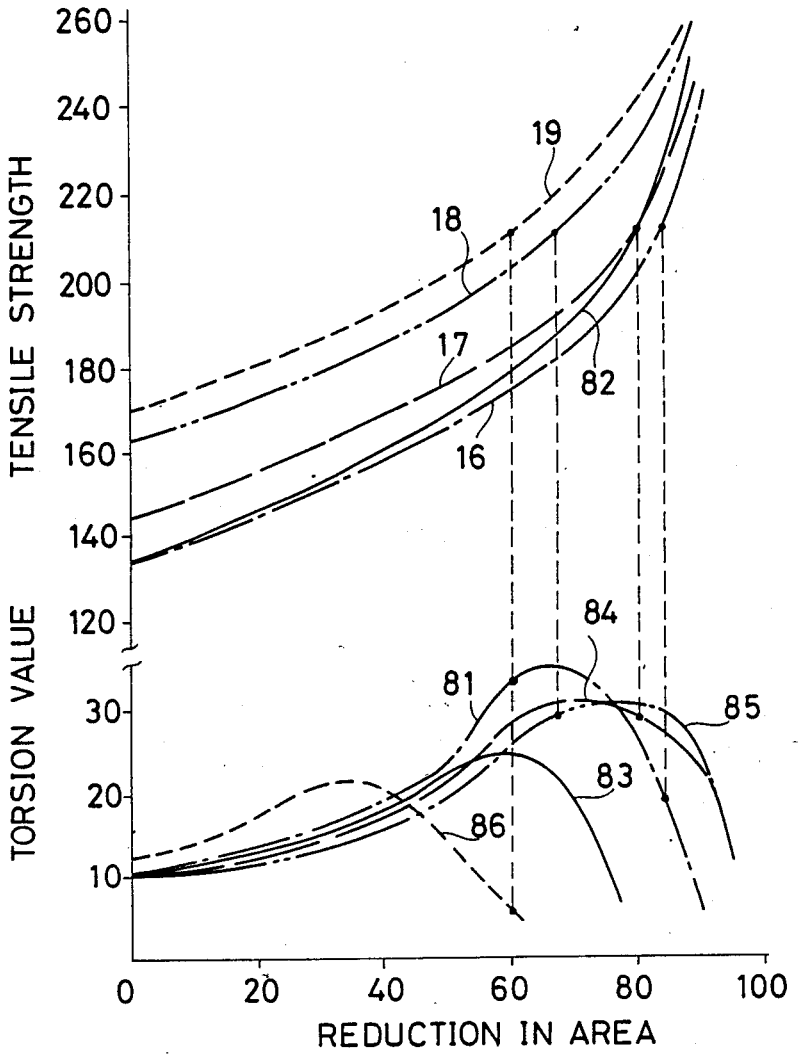
FIG. 8 is to show the relationship among tensile strength and reduction in area.

FIG. 8 shows tensile strength and torsion value against total reduction in area when the device shown in FIG. 4 is used for drawing to the wire materials of Si series and Si - Mn - Cr series except for the first die. The wire material of 133 kgf/mm$^2$ patenting strength shown by line 16 is ordinary material (conventional) with the compositions of 0.82 C, 0.3 Si and 0.5 Mn, while the materials of 143 kgf/mm$^2$ patenting strength shown by line 17 and of 162 kgf/mm$^2$ shown by line 18 are respectively the materials by this invention of Si series and Si -Mn - Cr series. The one with 170 kgf/mm$^2$ patenting strength shown by line 19 includes 4.0% of Si content. The torsion value of the above materials shown by line 16, 17, 18, and 19 are respectively as indicated by line 81, 84, 85 and 86.

As is known clearly from the drawing, ordinary wire materials fails to meet the required torsion value of 20 turns when the tensile strength exceed (240–68 log d) kgf/mm$^2$ (17 turns to line 81). With the wire materials by this invention, however, torsion value of more than 20 turns can be met even at higher tensile strength than (240–68 log d) kgf/mm$^2$. (28 times with line 84, and 27 times with line 80.) With the material of higher Si content of 4%, embrittlement is significant and the torsion value is very low (several times with line 86). To the wire materials of this invention, it is necessary to limit reduction in area to 70–93% and the tensile strength exceeds (240–68 log d) kgf/mm$^2$ at lower reduction in area than 70% and the twisting is less than 20 turns at higher reduction in area than 93%.

Figure 9:
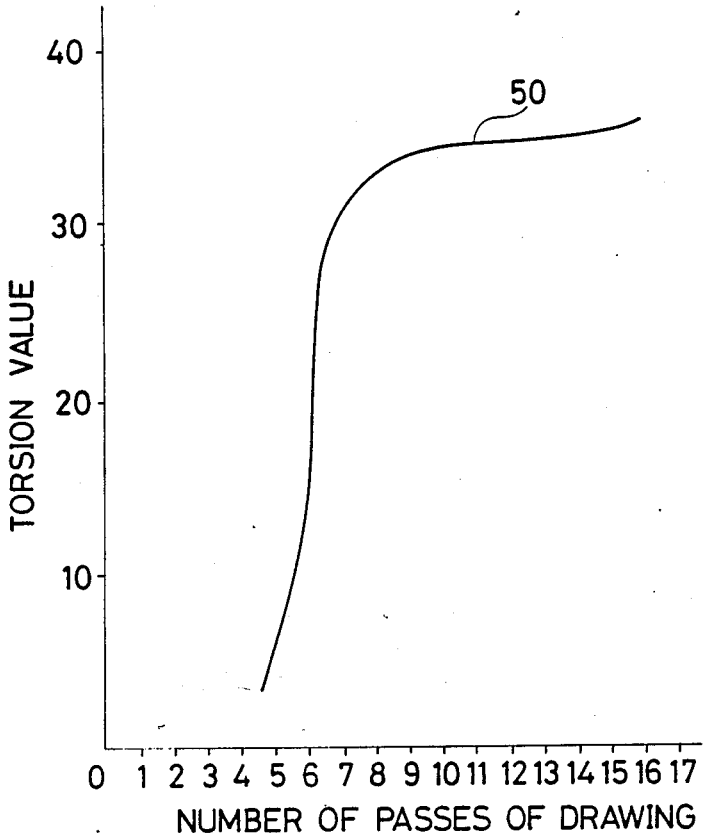
FIG. 9 is to show the relationship between the torsion value and the number of passes of drawing.

It is also necessary to limit patenting strength over 140 kgf/mm$^2$ because the tensile strength exceeding (248–68 log d) kgf/mm$^2$ and twisting of over 20 turns can be met when the patenting strength is kept at this level. Ordinary wire materials are affected by cooling after drawing and when no cooling is applied after drawing, the material having the characteristic of line 82 is embrittled significantly as shown by line 83. Since the wire materials of this invention show the same tendency, the cooling as described in FIG. 4 is essential. The lower limit of the number of passes of drawing is set at 7 as the reduction in area per one die is too much at less than 6 turns and sharp embrittlement is resulted as shown by line 50 in FIG. 9 due to excessive heat generation. If on the other hand, the number of times of drawing is too much, the economical performance becomes lower though it is free from any problem in the characteristics. Accordingly, the upper limit is set at 16 times.

Figure 10:
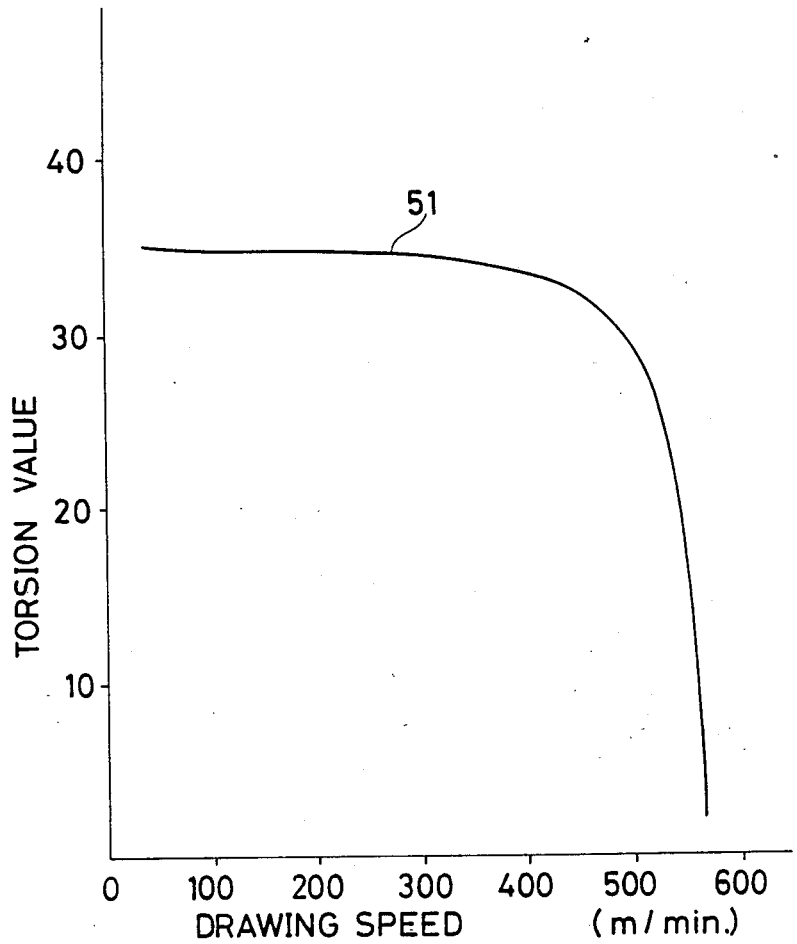
FIG. 10 shows the relationship between the torsion value and drawing speed.

Line No. 51 of FIG. 10 shows the relationship between the torsion value and drawing speed of the wires having tensile strength of exceeding (240–68 log d) kgf/mm$^2$. The drawing speed of 550 m/minute maximum is desireable as the torsion value is sharply reduced and wires are broken at higher speed than 550 m/minute. The lower limit of drawing is set at 50 m/minute though the drawing is free from embrittlement at low speed side but the economical performance is lower. Accordingly, this invention is to be composed as shown below:

Compositions . . . As described above

Drawing method . . . Drawing and cooling immediately after the drawing

Patenting strength . . . Over 140 kgf/mm$^2$

Number of passes of drawing . . . 7–16 times

Drawing speed . . . 50–550 m/minute

Reduction in area . . . 70–93%

High tension and highly tough steel wires having tensile strength exceeding (240–68 log d) kgf/mm$^2$ and torsion value of over 20 turns can be manufactured by limiting each one of the above conditions to the specific range.

Embodiment - 1

The components are set at 0.87 C - 1.2 Si - 1.2 Mn -0.020 P - 0.010 S, for Si - Mn series, 0.84 C - 1.2 Si - 0.50 Mn - 0.20 Cr - 0.021 P - 0.015 S for Si - Mn - Cr series, and at 0.82 C - 0.50 Mn - 0.40 Si - 0.018 P - 0.017 S for ordinary wire rod.

A high-frequency induction furnace is used for melting, wire rods of 13 mm and 9.5 mm diameters are made through ordinary blooming and rolling, and the following wires are made of the rods.

(1) PC wire

The rods of 13 mm diameter are subjected to patenting at 560° C. to Si - Mn and Si - Mn - Cr series and at 500° C. to ordinary wire materials, each rod is made to the tensile strength of 152 kgf/mm$^2$, 154 kgf/mm$^2$ and 131 kgf/mm$^2$ respectively, subjected to pickling, phosphate coating and cooling, then drawn to 5 mm diameter at 180 m/minute drawing speed and by 9 passes of drawing. (86 of drawing) The ordinary materials are also drawn without cooling and the wire materials of Si - Mn series and Si - Mn - Cr series are also drawn at 10 m/minute, without cooling, and by 6 passes of drawing to prepare samples for comparison. The comparison is as shown in Table 1.

As Table 1 indicates, the materials by this invention show a high strength, better toughness, and higher fatigue strength, while with the ordinary materials, the strength is lowered when the toughness is increased, and the toughness deteriorates greatly if the strength is increased. Even with materials of the same components as that of the materials by this invention, wires of high strength and also of high toughness can't be obtained if the drawing conditions are not adequate.

(2) Galvanized wire

The wires of 5 mm diameter made in the manner as shown in Table 1 are subjected to galvanizing at 440° C., and the strength and toughness are as shown in Table 2. As therein indicated, high strength and high toughness are maintained even after galvanizing. It is obvious that the toughness after galvanizing is very low even with the same compositions as those of the wire material by this invention if the drawing conditions are not set adequately.

TABLE 1

| Components | Cooling method Drawing condition | Tensile strength (kg/mm$^2$) | Elongation (%) | Reduction of area (%) | Torsion value (Turns) | Relaxation value (%) | Fatigue strength (kg/mm$^2$) |
|---|---|---|---|---|---|---|---|
| Si—Mn series | 6 times of drawing | | | | | | |
| (Sample for comparison) | 10 meter/minute No water cooling | 248 | 2.4 | 20 | 7 | 1.1 | 36 |
| (This invention) | 9 passes of drawing 180 meter/minute Water cooling for 8 passes | 231 | 6.2 | 41 | 32 | 1.0 | 67 |
| Si—Mn—Cr series | 6 times of drawing | | | | | | |
| (Sample for comparison) | 10 meter/minute No water cooling | 249 | 2.8 | 19 | 6 | 1.0 | 40 |

TABLE 1-continued

| Components | Cooling method Drawing condition | Tensile strength (kg/mm²) | Elongation (%) | Reduction of area (%) | Torsion value (Turns) | Relaxation value (%) | Fatigue strength (kg/mm²) |
|---|---|---|---|---|---|---|---|
| (This invention) | 9 times of drawing 180 meter/minute Water cooling for 8 passes | 233 | 6.8 | 44 | 38 | 0.9 | 66 |
| Ordinary material | Water cooling | 192 | 6.1 | 45 | 28 | 1.5 | 55 |
| | No water cooling | 223 | 2.0 | 21 | 5 | 1.0 | 24 |

TABLE 2

| Components | Cooling method Drawing conditions | Temperature of galvanizing (°C.) | Tensile strength (kg/mm²) | Elongation (%) | Torsion value (Time) | Fatigue strength (kg/mm²) |
|---|---|---|---|---|---|---|
| Si—Mn series (For comparison) | 6 times of drawing 10 m/minute No water cooling | 440 | 230 | 4.8 | 5 | 30 |
| (This invention) | 9 times of drawing 180 m/minute Water cooling for 8 passes | 440 | 220 | 6.8 | 25 | 59 |
| Si—Mn—Cr series (For comparison) | 6 times of drawing 10m/minute No water cooling | 440 | 231 | 4.2 | 5 | 35 |
| (This invention). | 9 times of drawing 180 m/minute Water cooling | 440 | 223 | 6.9 | 29 | 58 |
| Ordinary material | Water cooling | 440 | 168 | 5.8 | 24 | 41 |
| | No water cooling | 440 | 208 | 1.8 | 4 | 18 |

(3) PC strand

After drawing the rods of 13 mm diameter described above to 11.4 mm and 10.9 mm diameters, those of Si - Mn series and Si - Cr series are subjected to patenting at 560° C. and ordinary wire materials are at 510° C. to the tensile strength of 156 kgf/mm², 155 kgf/mm² and 133 kgf/mm² respectively. After pickling, and phosphate coating, cooling immediately after drawing is applied, the materials of 11.4 mm diameter are drawn 8 passes at 200 m/minute speed to 4.40 mm and the materials of 10.9 mm diameter to 4.22 mm (85% drawing). Ordinary wire materials are also made under the condition of no water cooling. For Si - Cr series and Si - Mn series, wires of 4.40 mm and 4.2 mm diameters are also made under the conditions of 6 passes of drawing, 10 m/minute drawing speed, and without cooling. Then PC strand of 7 wires, 0.5 inch size is prepared by using 4.40 mm wires as the core and 4.22 mm wires as the sides. After bluing at 380° C., the characteristics are compared as shown in Table 3.

The anchoring efficiency in the table is determined by the following equation.

Anchoring efficiency=(Tensile breaking load by wedge fixing)×100/(Breaking load of the strand of ordinary test material)

The minimum stress and the stress width of the fatigue fracture test are constant at 0.6 times of the tensile strength and 15 kgf/mm² respectively. As Table 3 indicates, the strength of the ordinary wire materials by cooling and drawing is low and the fatigue characteristic is not favourable either. When no cooling is applied after drawing, the ordinary materials show significant embrittlement and no stranded wires can be manufactured. It is also obvious that the elongation is low, the anchoring efficiency is low, and embrittlement is significant even with the materials of Si - Mn or Si - Cr series unless the drawing conditions are set adequately. While the materials of the present invention have a high strength of around 220 kg/mm² and evidently show exceeding fatigue characteristics.

(4) Galvanized steel wire for aluminium cable steel reinforced (ACSR)

After primary drawing of the above described rods of 9.5 mm diameter to 8 mm, those of Si - Mn series and Si - Mn - Cr series are subjected to patenting at 570° C. and the ordinary wire materials at 530° C. to make the tensile strength to 160 kgf/mm², 158 kgf/mm² and 134 kgf/mm² respectively, then subjected further to pickling, phosphate coating, and cooling after drawing. The wires are drawn further to 2.52 mm (90% drawing) by 12 passes of drawing and at 240 m/minute drawing speed, then are subjected to HCl treatment, flux treatment, and Zn plating at 442° C. to obtain Zn plated wires of 2.6 mm diameter for ACSR. With the ordinary wires materials, the plated wires of 2.6 mm diameter are also prepared without cooling. The wire materials of Si - Mn series, and of Si - Mn - Cr series are also drawn into 2.6 mm diameter without water cooling by 6 passes of drawing, at 10 m/minute drawing speed.

The results are as shown in Table 4. In the table, unwinding means the repeated motion of winding and unwinding and the plated wires are wound around and unwounded from another wire of the same diameter to check surface flaw. As to the winding property, the plated wires are wound around a rod with diameter of 15 times larger than the diameter of the wire to be tested and the property is judged from the condition. The table indicates that the wire materials by this invention have a high strength and high toughness.

TABLE 3

| Components | Cooling method Drawing conditions | Tensile strength (kg/mm$^2$) | Elongation (%) | Relaxation value (%) | Anchoring efficiency (%) | Number of times of repetition of fatigue break-down |
|---|---|---|---|---|---|---|
| Si—Mn series (Sample for comparison) | 6 times of drawing 10 m/minute No water cooling | 238 | 2.1 | 1.5 | 78 | Broken at $2 \times 10^6$ times |
| (This invention) | 8 times of drawing 200 m/minute Water cooling | 226 | 6.5 | 1.6 | 99 | No break-down at $10^5$ times |
| Si—Mn—Cr series (Sample for comparison) | 6 times of drawing 10 m/minute No water cooling | 235 | 2.0 | 1.6 | 70 | Broken at $3 \times 10^6$ times |
| (This invention) | 8 times of drawing 200 m/minute Water cooling | 228 | 6.5 | 1.5 | 98 | No break-down at $10^5$ times |
| Ordinary wire material | Water cooling | 188 | 6.4 | 1.5 | 98 | $2 \times 10$ |
| | No water cooling | Wire breakage happens frequently at stranding and no stranded wires can be manufactured. | | | | |

TABLE 4

| Component | Cooling method drawing conditions | Tensile strength (kg/mm$^2$) | Elongation (%) | Torsion value (Times) | Evenness (Times) | Winding property r = 15 d | Deposition quantity (g/mm$^2$) | Unwinding 8 times |
|---|---|---|---|---|---|---|---|---|
| Si—Mn series (For comparison) | 6 times of drawing 10 m/minute No water cooling | 240 | 1.0 | 5 | 4 | Broken | 300 | Broken |
| (This invention) | 12 times of drawing 240 m/minute Water cooling | 224 | 5.5 | 28 | 4 | Good | 200 | Good |
| Si—Mn—Cr series (For comparison) | 6 times of drawing 10 m/minute No water cooling | 238 | 2.8 | 6 | 4 | Broken | 285 | Broken |
| (This invention) | 12 times of drawing 240 m/minute Water cooling | 227 | 5.8 | 27 | 4 | Good | 285 | Good |
| Ordinary wire material | Water cooling | 181 | 5.9 | 25 | 3.5 | Good | 295 | Good |
| | No water cooling | 211 | 1.8 | 5 | 3.5 | Good | 300 | Broken |

(5) Rope

The rods of 13 mm diameter described above are drawn into wires of 10.85 mm and 10.45 mm diameters, then the wires are subjected to patenting at 570° C. to those of Si - Mn series and Si - Mn - Cr series, and at 550° C. to ordinary wire materials. The results are as shown respectively in Table 5.

Figure 11:
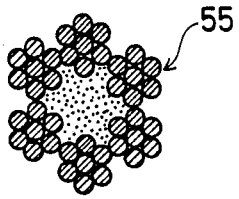
FIG. 11 is a sectional view of a rope.
Figure 12:
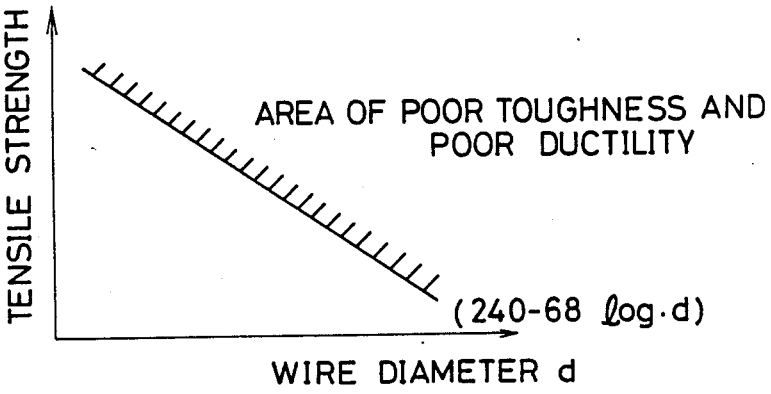
FIG. 12 shows the relationship between the tensile strength and wire diameter and indicates the area of poor toughness and poor ductility.

After pickling, phosphate coating, and cooling after drawing, the wires are drawn further to 90% drawing; the wires 10.85 mm to 3.43 mm and those of 10.45 mm to 3.30 mm respectively by 12 passes of drawing and at 250 m/minutes of drawing speed. By using the wires of 3.43 mm diameter as the core, and those of 3.30 mm diameter as the side wires, strand of 7 wires, and 6 pieces of such stranded wires are twisted together into a rope of 30 mm outside diameter as shown in FIG. 11. With the ordinary wire materials, ropes are also prepared without cooling after drawing when the strands are made. The results are shown in Table 6. The fatigue test is practiced under the condition of 10.0 toms test load, 460 mm shieve diameter, and 16° bending angle, and the number of times of repetitive bending to break-down is found.

As the table indicates, the materials of this invention show a high strength and the fatigue life is 5 times longer than that of ordinary wire materials.

TABLE 5

| | Components | | |
|---|---|---|---|
| Size | Si—Mn | Si—Mn—Cr | Ordinary wire material |
| 10.85 $\phi$ | 154 kg/mm$^2$ | 157 kg/mm$^2$ | 133 kg/mm$^2$ |
| 10.45 $\phi$ | 156 kg/mm$^2$ | 158 kg/mm$^2$ | 135 kg/mm$^2$ |

TABLE 6

| Components | Cooling method | Rope break-down load (t) | Tensile strength of rope (kg/mm$^2$) | Fatigue test (Number of times of repetitive bending to break-down) |
|---|---|---|---|---|
| Si—Mn series (This invention) | Water cooling | 83.2 | 231.7 | 40,000 times |
| Si—Mn—Cr series (This invention) | Water cooling | 84.9 | 236.6 | 41,000 times |
| Ordinary wire materials | Water cooling | 68.4 | 190.5 | 8,000 times |
| | No water | The stranded wires are broken frequently and no ropes can be | | |

TABLE 6-continued

| Components | Cooling method | Rope break-down load (t) | Tensile strength of rope (kg/mm²) | Fatigue test (Number of times of repetitive bending to break-down) |
|---|---|---|---|---|
| | cooling | | manufactured. | |

Embodiment - 2

Wire materials of 12.7 mm diameter and of Si - Mn - Al series are subjected to lead patenting to the tensile strength of 139 kgf/mm², 139 kgf/mm², and ordinary material for comparison 131 kgf/mm² respectively. Then, they are drawn to 3.7 mmϕ wires by 91.5% reduction, and are subjected to bending test at 3 mm radius of curvature after bluing at 350° C. The results are as shown in the following table.

table, sample 1 and sample 2 are respectively 3 mm and 5 mm in diameter with tensile strength of 150 kgf/mm² after patenting, and are drawn to 0.96 mm and 1.6 mm respectively. The samples 3, 4 and 5 are subjected to patenting at the diameters of 3 mm, 5 mm and 6 mm, and the tensile strength is obtained at the values of 124 kgf/mm², 130 kgf/mm² and 129 kgf/mm² respectively, and such wires are drawn to 0.96 mm, 1.60 mm and 1.60 mm diameter respectively.

| | C | Si | Mn | Al | N | Drawing: No. of passes | Drawing: Speed (m/minute) | Tensile strength of drawn wire kg/mm² | After bluing: Ratio of breakage | After bluing: Torsion value | After bluing: Delamination |
|---|---|---|---|---|---|---|---|---|---|---|---|
| Method of this invention | 0.81 | 0.75 | 0.80 | 0.060 | 1.008 | 14 | 100 | 228 | 0% | 28 | No crack |
| Other method for comparison | | | | | | 10 | 100 | 231 | 17% | 22 | No crack |
| Material for comparison | 0.82 | 0.25 | 0.73 | 0.004 | 0.003 | 10 | 100 | 224 | 65% | 10 | Cracked |

Embodiment - 4

When wire materials of 13 mm diameter are used,the results are as shown in the following table.

| | C | Si | Mn | Al | N | Tensile strength of lead patenting kgf/mm² | Drawing: Reduction | Drawing: No. of passes | Drawing: Speed (m/minute) | Drawn wire: Tensile strength | Drawn wire: Tortion value | Drawn wire: Delamination |
|---|---|---|---|---|---|---|---|---|---|---|---|---|
| This invention | 0.77 | 0.92 | 0.75 | 0.055 | 0.009 Cr: 0.20 | 139 | 90.5% | 12 | 150 (Water cooling) | 229 | 28 | No crack |
| Material for comparison | 0.76 | 0.22 | 0.71 | 0.010 | 0.003 | 126 | 90.5% | 9 | 30 (No water cooling) | 230 | 6 | Cracked |

Embodiment - 5

When wire materials of 9 mm diameter are drawn to 2.5 mm diameter and galvanizing is applied at 440° C., the results are as shown in the following table.

| | C | Si | Mn | Al | N | Tensile strength of lead patenting kgf/mm² | Drawing: Reduction | Drawing: No. of times | Drawing: Speed (m/minute) | After plating: Tensile strength | After plating: Tortion value | After plating: Delamination |
|---|---|---|---|---|---|---|---|---|---|---|---|---|
| This invention | 0.85 | 1.10 | 2.92 | 0.061 | 0.008 | 148 | 92% | 14 | 220 (Water cooling) | 283 | 27 | No crack |
| Material for comparison | 0.83 | 0.27 | 0.68 | 0.045 | 0.003 | 134 | 92% | 6 | 220 (Water cooling) | 203 | 16 | Cracked |
| Material for comparison | 0.83 | 0.27 | 0.68 | 0.045 | 0.003 | 134 | 92% | 6 | 220 (No water cooling) | Broken in the middle of drawing | | |

Embodiment - 5

After applying lead patenting, 8 passes of drawing and direct cooling (300 m/minute) to the wire materials of above described Si - Mn series, stress-relieving is performed at 400° C. in the lead bath, then copper is deposited on the surface by substitution plating, and the wires are tested as shown in the following table. In the Chemical compositions of each sample is as follows:

Sample No. 1: 0.83 C - 1.2 Si - 0.70 Mn
Sample No. 2: 0.72 C - 0.25 Si - 0.50 Mn
Sample No. 3: 0.82 C - 1.15 Si - 0.72 Mn
Sample No. 4: 0.82 C - 0.20 Si - 0.55 Mn
Sample No. 5: 0.82 C - 0.24 Si - 0.51 Mn

| | | Initial size (mm) | Tensile strength (kgf/mm$^2$) | No. of times of twisting (Times) | Break-down at twisting | Sample No. |
|---|---|---|---|---|---|---|
| 0.96 $\phi$ size | This invention | 3.0 | 288 | 28 | Normal | 1 |
| | Sample for comparison | 5.0 | 202 | 27 | Normal | 2 |
| 1.6 $\phi$ size | This invention | 3.0 | 284 | 27 | Normal | 3 |
| | Sample for comparison | 5.0 | 218 | 26 | Normal | 4 |
| | Sample for comparison | 6.0 | 280 | 12 | Delamination (Vertical crack) | 5 |

Effect of the Invention

As described above, the present invention is to enable manufacturing steel wires of high strength and high toughness by adjusting the compositions such as C, Si, Mn, Cr, Al and N adequately and by setting the drawing conditions such as the number of passes of drawings, drawing speed, direct water cooling and total reduction in area within the adequate range respectively.

This invention, in particular, leads to the following results of each product.

(A) PC wire and PC strand

Economical effects corresponding to reduced consumption of steel materials and corresponding to reduced consumption of concrete introduction of high prestressing force.

(B) Core wire for aluminium cable steel reinforced

Less consumption of steel wire materials due to increase in electric power transmission capacity corresponding to increased area of aluminium conductor by compact design of ACSR strand and due to compact design of core steel wire.

(C) Rope

Economical effect corresponding to reduced consumption of steel wire materials by reduced rope size, and the effect of compact design of the whole equipment by reduced rope weight owing to smaller rope size and by smaller sheave.

This invention also enables to reduce consumption of steel wire materials for such products as galvanized steel wire for long-span suspension bridge, uncoated wire for stay cables for bridges, bead wire, spring wire, etc. and saving in the cost is expected.

What is claimed is:

1. A process for producing a high strength and high toughness steel article having a bar, rod, or wire shape, said process comprising:

(i) adjusting the chemical composition of a high carbon steel article to a carbon content of from 0.7 to 1.0%, a silicon content of from 0.5 to 2.0%, and a manganese content of from 0.3 to 2.0%, and the balance iron with incidental impurities;

(ii) adjusting said high carbon steel article to a fine pearlite structure;

(iii) adjusting the tensile strength of the said high carbon steel article, in a patenting process, to a tensile strength greater than 140 kgf mm$^{-2}$;

(iv) in multiple stages, drawing the said article into a desired size by passing the said article through dies from 7 to 16 times at a drawing speed of from 50 to 500 m min$^{-1}$ and a reduction in area of from 70 to 93%, and with cooling of the said drawn article with water immediately after each individual drawing stage during the later stages of the drawing process; and (v) obtaining an article having a tensile strength greater than (260 - 68 log d) kgf mm$^{-2}$.

2. The process of claim 1, comprising cooling the said drawn article with water after each individual drawing stage during the whole drawing process.

3. A process for producing a high strength and high toughness steel article having a bar, rod, or wire shape, said process comprising:

(i) adjusting the chemical composition of a high carbon steel article to a carbon content of from 0.7 to 1.0%, a silicon content of from 0.5 to 2.0%, a manganese content of from 0.3 to 2.0%, and a chromium content of from 0.1 to 0.5%, and the balance iron with incidental impurities;

(ii) adjusting said high carbon steel article to a fine pearlite structure;

(iii) adjusting the tensile strength of the said high carbon steel article, in a patenting process, to a tensile strength greater than 140 kgf mm$^{-2}$;

(iv) in multiple stages, drawing the said high carbon steel article into a desired size by passing the said article through dies from 7 to 16 times at a drawing speed of from 50 to 500 m min$^{-1}$ with a reduction in area of from 70 to 93%, and with cooling of the said drawn article with water immediately after each individual drawing stage during the later stages of the drawing process; and (v) obtaining an article having a tensile strength greater than (260 - 68 log d) kgf mm$^{-2}$.

4. The process of claim 3, comprising cooling the said drawn article with water immediately after each individual drawing stage during the whole drawing process.

5. A process for producing a high strength and high toughness steel article having a bar, rod, or wire shape, said process comprising:

(i) adjusting the chemical composition of a high carbon steel article to a carbon content of from 0.7 to 1.0%, a silicon content of from 0.5 to 2.0%, a manganese content of from 0.3 to 2.0%, an aluminum content of from 0.02 to 0.10%, and a nitrogen content of from 0.003 to 0.015%, and the balance iron with incidental impurities;

(ii) adjusting said high carbon steel article to a fine pearlite structure;

(iii) adjusting the tensile strength of the said high carbon steel article, in a patenting process, to a tensile strength greater than 140 kgf mm$^{-2}$;

(iv) in multiple stages, drawing the said high carbon steel article into a desired size by passing the said article through dies from 7 to 16 times at a drawing speed of from 50 to 500 m min$^{-1}$ with a reduction in area of from 70 to 93%, and with cooling of the said drawn article with water immediately after each individual drawing stage during the later stages of the drawing process; and (v) obtaining an article having a tensile strength greater than (260 - 68 log d) kgf $mm^{-2}$.

6. The process of claim 5, comprising cooling the said drawn article with water immediately after each individual drawing stage during the whole drawing process.

7. A process for producing a high strength and high toughness steel article having a bar, rod, or wire shape, said process comprising:

(i) adjusting the chemical composition of a high carbon steel article to a carbon content of from 0.7 to 1.0%, a silicon content of from 0.5 to 3.0%, a manganese content of from 0.3 to 2.0%, a chromium content of from 0.1 to 0.5%, an aluminum content of from 0.02 to 0.10%, and a nitrogen content of from 0.003 to 0.015%, and the balance iron with incidental impurities;

(ii) adjusting said high carbon steel article to a fine pearlite structure;

(iii) adjusting the tensile strength of the said high carbon steel article, in a patenting process, to a tensile strength greater than 140 kgf $mm^{-2}$;

(iv) in multiple stages, drawing the said high carbon steel article into a desired size by passing the said article through dies 7 to 16 times at a drawing speed of from 50 to 500 m $min^{-1}$ and a reduction in area of from 70 to 93%, and with cooling of the said drawn article with water immediately after each individual drawing stage during the whole drawing process; and (v) obtaining an article having a tensile strength greater than (260 - 68 log d) kgf $mm^{-2}$.

8. The process of claim 7, comprising cooling the said drawn article with water immediately during the later stages of the drawing process.

9. A high strength and high toughness steel article having a bar, rod, or wire shape, said high strength and high toughness steel article having a carbon content of from 0.7 to 1.0%, a silicon content of from 0.5 to 2.0%, a manganese content of from 0.3 to 2.0%, and the balance iron with incidental impurities, wherein the finished product has a tensile strength greater than (260 - 68 log d) kgf $mm^{-2}$, and a torsional value, without abnormal fracture, which is greater than 20 turns for a span having a length of 100 d, where d is the diameter of the steel article, wherein the said high strength and high toughness steel article is obtained by:

(i) adjusting the chemical composition of a high carbon steel article to a carbon content of from 0.7 to 1.0%, a silicon content of from 0.5 to 2.0%, and a manganese content of 0.3 to 2.0% and the balance iron with incidental impurities;

(ii) adjusting said high carbon steel article to a fine pearlite structure;

(iii) adjusting the tensile strength of the said high carbon steel article, in a patenting process, to a tensile strength greater than 140 kgf $mm^{-2}$; and (iv) in multiple stages, drawing the said high carbon steel article to a desired size by passing the said article through dies 7 to 16 times at a drawing speed of from 50 to 500 m $min^{-1}$ with a reduction in area of from 70 to 93%, and with cooling of the said drawn article with water immediately after each individual drawing stage during the later stages of the drawing process.

10. The high strength and high toughness steel article of claim 9, wherein the said high strength and high toughness steel article is obtained by cooling the said drawn article with water immediately after each individual drawing stage during the whole drawing process.

11. A high strength and high toughness steel article having a bar, rod, or wire shape, said high strength and high toughness steel article having a carbon content of from 0.7 to 1.0%, a silicon content of from 0.5 to 2.0%, a manganese content of from 0.3 to 2.0%, and a chromium content of from 0.1 to 0.5%, and the balance iron with incidental impurities, wherein the finished product has a tensile strength greater than (260 - 68 log d) kgf $mm^{-2}$, and a torsional value, without abnormal fracture, which is greater than 20 turns for a span having a length of 100 d, where d is the diameter of the said steel article, wherein the said high strength and high toughness steel article is obtained by:

(i) adjusting the chemical composition of a high carbon steel article to a carbon content of from 0.7 to 1.0%, a silicon content of from 0.5 to 2.0%, a manganese content of 0.3 to 2.0%, and a chromium content of from 0.1 to 0.5% and the balance iron with incidental impurities;

(ii) adjusting said high carbon steel article to a fine pearlite structure, and (iii) adjusting the tensile strength of the said high carbon steel article, in a patenting process, to a tensile strength greater than 140 kgf $mm^{-2}$; and (iv) in multiple stages, drawing the said high carbon steel article to a desired size by passing the said article through dies 7 to 16 times at a drawing speed of 50 to 500 m $min^{-1}$ with a reduction in area of from 70 to 93%, and with cooling of the said drawn article by water immediately after each individual drawing stage during the later stages of the drawing process.

12. The high strength and high toughness steel article of claim 11, wherein the said high strength and high toughness steel article is obtained by cooling the said drawn article with water immediately after each individual drawing stage during the whole drawing process.

13. A high strength and high toughness steel article having a carbon content of from 0.7 to 1.0%, a silicon content of from 0.5 to 2.0%, a manganese content of from 0.3 to 2.0%, an aluminum content from 0.02 to 0.10%, a nitrogen content of from 0.003 to 0.015%, and the balance iron with incidental impurities, wherein the finished product has a tensile strength of the finished product greater than (260 - 68 log d) kgf $mm^{-2}$, and a torsional value, without abnormal fracture, which is greater than 20 turns for a span having a length of 100 d, where d is the diameter of the said steel article, wherein the said high strength and high toughness steel article is obtained by:

(i) adjusting the high carbon steel article having a carbon content of from 0.7 to 1.0%, a silicon content of from 0.5 to 2.0%, a manganese content of 0.3 to 2.0%, an aluminum content of from 0.02 to 0.10%, and a nitrogen content of from 0.003 to 0.015%, and the balance iron with incidental impurities;

(ii) adjusting said high carbon steel article to a fine pearlite structure, and (iii) adjusting the tensile strength of the said high carbon steel article, in a patenting process, to a tensile strength greater than 140 kgf $mm^{-2}$; and (iv) in multiple stages, drawing the said high carbon steel article to a desired size by passing the article through dies 7 to 16 times at a drawing speed of from 50 to 500 m $min^{-1}$ with a reduction in area of from 70 to 93%, and with cooling of the said drawn article by water immediately after each individual drawing stage during the later stages of the drawing process.

14. A high strength and high toughness steel article having a bar, rod, or wire shape, wherein the said high strength and high toughness steel article has a carbon content of from 0.7 to 1.0%, a silicon content of from 0.5 to 2.0%, a manganese content of from 0.3 to 2.0%, a chromium content of from 0.1 to 0.5%, an aluminum content from 0.2 to 0.10%, a nitrogen content of from 0.003 to 0.015%, and the balance iron with incidental impurities, wherein the finished product has a tensile strength of the finished product greater than (260 - 68 log d) kgf $mm^{-2}$, and a torsional value, without abnormal fracture, which is greater than 20 turns for a span having a length of 100 d, where d is the diameter of the steel article, wherein the said high strength and high toughness steel article is obtained by:

(i) adjusting the chemical composition of a high carbon steel article to a carbon content of from 0.7 to 1.0%, a silicon content of from 0.5 to 2.0%, a manganese content of 0.3 to 2.0%, a chromium content of from 0.1 to 0.5%, an aluminum content of from 0.02 to 0.10%, and a nitrogen content of from 0.003 to 0.015% and the balance iron with incidental impurities;

(ii) adjusting said high carbon steel article to a fine pearlite structure, and (iii) adjusting the tensile strength of the said high carbon steel article, in a patenting process, to a tensile strength greater than 140 kgf $mm^{-2}$; and (iv) in multiple stages, drawing the said high carbon steel article to a desired size by passing the article through dies 7 to 16 times at a drawing speed of from 50 to 500 m $min^{-1}$ with a reduction in area of from 70 to 93%, and with cooling of the said drawn article by water immediately after each individual drawing stage during the later stages of the drawing process.

15. The high strength and high toughness steel of claim 14, wherein the said high strength and high toughness steel is obtained with cooling of the said drawn article with water immediately after each individual drawing stage during the whole drawing process.

16. The high strength and high toughness steel article of claim 13, wherein the said high strength and high toughness steel article is obtained by cooling the said drawn article with water immediately after each individual drawing stage during the whole drawing process.

* * * * *